US008319576B2

(12) United States Patent
Hasegawa

(10) Patent No.: US 8,319,576 B2
(45) **Date of Patent: *Nov. 27, 2012**

(54) MAGNETIC RESONANCE ISOLATOR

(75) Inventor: Takashi Hasegawa, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/487,283

(22) Filed: Jun. 4, 2012

(65) Prior Publication Data

US 2012/0242422 A1 Sep. 27, 2012

Related U.S. Application Data

(63) Continuation of application No. PCT/JP2010/067204, filed on Oct. 1, 2010.

(30) Foreign Application Priority Data

Dec. 26, 2009 (JP) ..... 2009-296455

(51) Int. Cl.
*H01P 1/36* (2006.01)

(52) U.S. Cl. ..... 333/24.2; 333/1.1

(58) Field of Classification Search ..... 333/1.1, 333/24.2

See application file for complete search history.

(56) References Cited

U.S. PATENT DOCUMENTS

| | | | | |
|---|---|---|---|---|
| 3,560,892 | A * | 2/1971 | Chiron | 333/1.1 |
| 3,835,420 | A * | 9/1974 | Orime et al. | 333/24.2 |
| 2009/0206943 | A1 | 8/2009 | Kawanami et al. | |

FOREIGN PATENT DOCUMENTS

| | | | |
|---|---|---|---|
| JP | 49-36248 | A | 4/1974 |
| JP | 63-260201 | A | 10/1988 |
| JP | 2001-326504 | A | 11/2001 |
| WO | 2009/001664 | A1 | 12/2008 |
| WO | 2009/128534 | A1 | 10/2009 |

OTHER PUBLICATIONS

Official Communication issued in International Patent Application No. PCT/JP2010/067204, mailed on Dec. 28, 2010.

* cited by examiner

*Primary Examiner* — Stephen Jones
(74) *Attorney, Agent, or Firm* — Keating & Bennett, LLP

(57) ABSTRACT

A magnetic resonance isolator includes a ferrite member, a junction conductor that is arranged on the ferrite member and that includes a first port, a second port, and a third port, a permanent magnet that applies a direct current magnetic field to the ferrite member, a capacitor as a reactance element, and a mounting substrate. A main line arranged between the first port and the second port does not resonate, and an end of a sub-line branching from the main line defines the third port. The capacitor is connected to the third port and to the ground. The phase of a wave reflected from the sub-line is adjusted so as to be shifted by about 90 degrees at the intersection of the junction conductor.

13 Claims, 15 Drawing Sheets

M1:1920MHz
-11.498dB

M2:1950MHz
-8.426dB

M3:1980MHz
-6.613dB

M1:1920MHz
-10.153dB

M2:1950MHz
-19.358dB

M3:1980MHz
-9.698dB

M1:1920MHz
-1.390dB

M2:1950MHz
-1.991dB

M3:1980MHz
-2.422dB

M1:1920MHz
-11.438dB

M2:1950MHz
-8.364dB

M3:1980MHz
-6.574dB

M1:1920MHz
-11.169dB

M2:1950MHz
-8.485dB

M3:1980MHz
-7.141dB

M1:1920MHz
-12.592dB

M2:1950MHz
-26.161dB

M3:1980MHz
-11.115dB

M1:1920MHz
-1.395dB

M2:1950MHz
-1.917dB

M3:1980MHz
-2.338dB

M1:1920MHz
-11.075dB

M2:1950MHz
-8.455dB

M3:1980MHz
-7.068dB

MAGNETIC RESONANCE ISOLATOR

BACKGROUND OF THE INVENTION

1. Field of the Invention

The present invention relates to magnetic resonance isolators, and specifically to magnetic resonance isolators used in a microwave frequency band, for example.

2. Description of the Related Art

In general, an isolator has a characteristic of transmitting signals in a predetermined direction and not transmitting signals in the opposite direction, and is mounted in a transmitter circuit of a mobile communication apparatus, such as a cellular phone. Known examples of magnetic resonance isolators include isolators described in Japanese Unexamined Patent Application Publication No. 63-260201 and Japanese Unexamined Patent Application Publication No. 2001-326504. A magnetic resonance isolator utilizes a phenomenon in which, when high-frequency currents of equal amplitude whose phases differ by a quarter wavelength flow through two lines (with four ports) perpendicular to each other, a rotating magnetic field (circularly polarized wave) is generated at the intersection and the circulation direction of the circularly polarized wave is reversed in accordance with the propagation directions of the electromagnetic waves along the two lines. In other words, by arranging a ferrite member at the intersection and applying a static magnetic field necessary for magnetic resonance using a permanent magnet, a positive or negative circularly polarized wave is generated by a wave reflected from a sub-line in accordance with the propagation direction of an electromagnetic wave along a main line. When a positive circularly polarized wave is generated, a signal is absorbed due to the magnetic resonance of the ferrite member, and when a negative circularly polarized wave is generated, no magnetic resonance is generated, whereby the signal can pass through the intersection without attenuation. Reactance elements for reflecting the signals are connected to the ends of the sub-line.

However, such a known magnetic resonance isolator has a large size, for example, about 20 mm×about 20 mm for a frequency of about 2 GHz, since the main line is a quarter wavelength long so as to resonate and two reactance elements are mounted thereon. This is problematic in view of recent trends in mobile communication apparatuses, i.e., reduction in size and increasing component mounting density.

SUMMARY OF THE INVENTION

To overcome the problems described above, preferred embodiments of the present invention provide a small low-impedance magnetic resonance isolator.

A magnetic resonance isolator according to a first preferred embodiment of the present invention preferably includes a ferrite member, a junction conductor that is arranged on the ferrite member and that includes a first port, a second port, and a third port, and a permanent magnet that applies a direct current magnetic field to the ferrite member. The junction conductor preferably includes a main line arranged between the first port and the second port and a sub-line branching from the main line and extending to the third port, and the main line does not resonate, and a reactance element is connected to the third port and to the ground.

In the magnetic resonance isolator according to the first preferred embodiment, adjustment is made such that a wave reflected from the sub-line connected to the reactance element has a phase which is different by 90 degrees from that of an input wave from each of the first port and the second port at the intersection of the junction conductor. Thereby, a positive or negative circularly polarized wave is generated at the intersection. Signal absorption or transmission is achieved through the generation of a positive or negative circularly polarized wave as in the related art.

In the magnetic resonance isolator according to the first preferred embodiment, since the main line does not resonate, the length of the main line can be decreased to a quarter wavelength or less, and since the magnetic resonance isolator is a three-port type, only one reactance element is required. Therefore, a very small and low-impedance magnetic resonance isolator is obtained.

A magnetic resonance isolator according to a second preferred embodiment of the present invention preferably includes a ferrite member including a first main surface and a second main surface facing each other, a junction conductor that is arranged on the first main surface of the ferrite member and that includes a first port, a second port, and a third port, and a permanent magnet that applies a direct current magnetic field to the ferrite member. The junction conductor preferably includes a main line arranged between the first port and the second port and a sub-line branching from the main line and extending to the third port, and the main line does not resonate. The sub-line preferably includes an opposing conductor extending along the second main surface in a direction perpendicular or substantially perpendicular to the main line, an end of the opposing conductor defines the third port, and a reactance element is connected to the third port and to the ground.

The operating principle of the magnetic resonance isolator according to the second preferred embodiment is preferably similar to that of the magnetic resonance isolator according to the first preferred embodiment. In the magnetic resonance isolator according to the second preferred embodiment, since the opposing conductor extending along the second main surface of the ferrite member in a direction perpendicular or substantially perpendicular to the main line is arranged so as to extend from the sub-line, a high-frequency magnetic field is confined within the ferrite member due to the opposing conductor such that leakage of the magnetic flux is reduced and the insertion loss is significantly reduced and prevented.

A magnetic resonance isolator according to a third preferred embodiment of the present invention preferably includes a ferrite member including a first main surface and a second main surface facing each other, a junction conductor that is arranged on the first main surface of the ferrite member and that includes a first port, a second port, and a third port, a permanent magnet that applies a direct current magnetic field to the ferrite member, and a mounting substrate. The junction conductor preferably includes a main line arranged between the first port and the second port and a sub-line branching from the main line and extending to the third port, and the main line does not resonate. An end of the sub-line defines the third port, and a reactance element is connected to the third port and to the ground. The ferrite member is preferably sandwiched between a pair of permanent magnets respectively facing the first and second main surfaces, and mounted on the mounting substrate such that the first and second main surfaces extend in a direction perpendicular or substantially perpendicular to a surface of the mounting substrate.

The operating principle of the magnetic resonance isolator according to the third preferred embodiment is preferably similar to that of the magnetic resonance isolator according to the first preferred embodiment. In the magnetic resonance isolator according to the third preferred embodiment, the ferrite member is preferably vertically or substantially vertically arranged on the mounting substrate in a state in which the ferrite member is sandwiched between a pair of permanent magnets respectively facing the first and second main surfaces of the ferrite member. Only a portion of the junction conductor parallel or substantially parallel to the thickness direction and provided on the ferrite member that is arranged vertically or substantially vertically on the mounting substrate faces a ground electrode, the impedance is increased and the insertion loss is reduced.

According to various preferred embodiments of the present invention, a small low-impedance magnetic resonance isolator is obtained.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
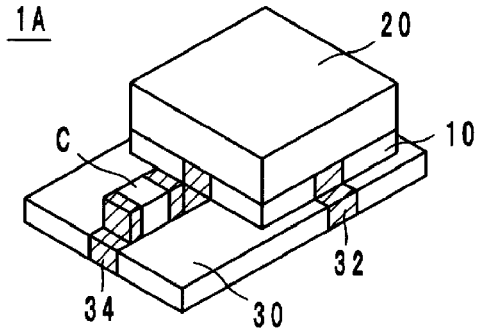
FIG. 1 is a perspective view of a magnetic resonance isolator according to a first preferred embodiment of the present invention.

Hereinafter, preferred embodiments of a magnetic resonance isolator according to the present invention are described with reference to the attached drawings. Note that in the drawings, common components or portions are denoted by the same reference numerals and duplicated descriptions thereof are omitted. Also note that shaded portions in the drawings represent conductors.

First Preferred Embodiment

Figure 2:
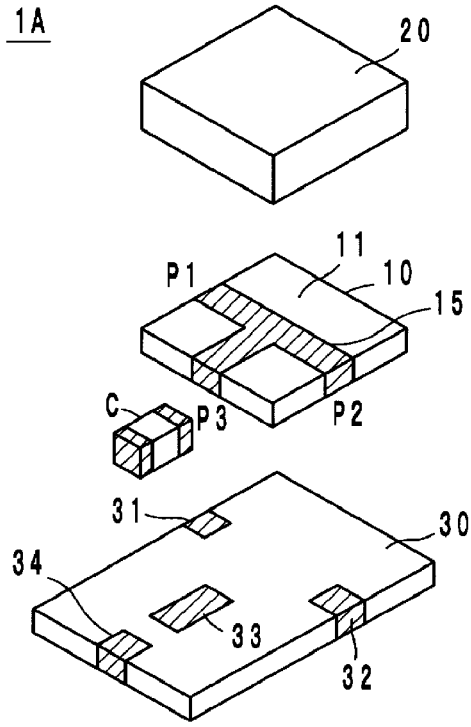
FIG. 2 is an exploded perspective view of a magnetic resonance isolator according to a first preferred embodiment of the present invention.

Referring to FIGS. 1 and 2, a magnetic resonance isolator 1A according to a first preferred embodiment of the present invention preferably includes a ferrite member 10, a T-shaped junction conductor 15 which is arranged on a first main surface 11 of the ferrite member 10 and which includes three ports P1, P2, and P3, a permanent magnet 20 that applies a direct current magnetic field to the ferrite member 10, a capacitor C as a reactance element, and a mounting substrate 30.

Figure 3A:
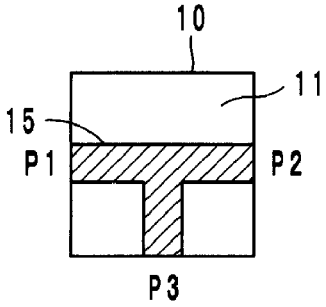
FIGS. 3A and 3B illustrate a front view and a back view, respectively, of a ferrite member of a magnetic resonance isolator according to a first preferred embodiment of the present invention.
Figure 3B:
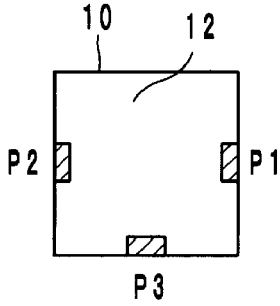
Figure 4:
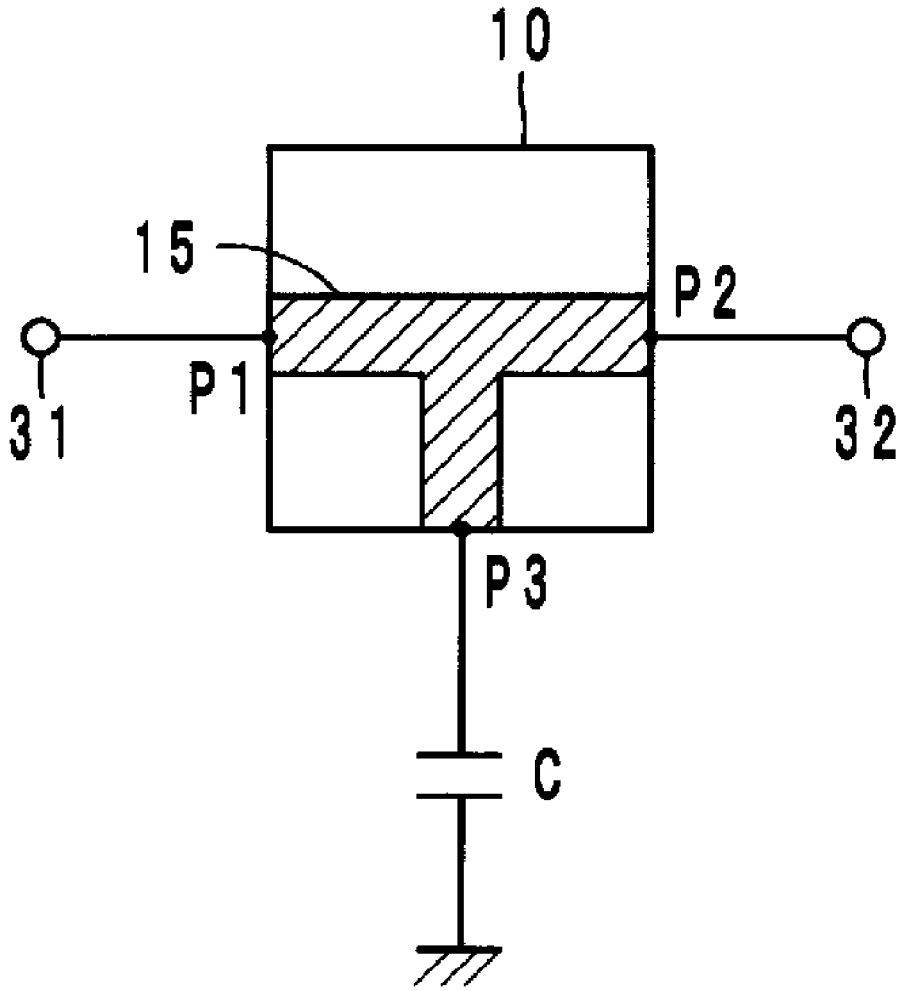
FIG. 4 is an equivalent circuit diagram of a magnetic resonance isolator according to a first preferred embodiment of the present invention.

The junction conductor 15 is preferably a thin film formed by conductive metal evaporation or a thick film formed by applying conductive paste and baking. Referring to FIGS. 3A, 3B, and 4, a main line arranged between the first port P1 and the second port P2 facing each other in a line, among the three ports P1, P2, and P3 of the junction conductor 15, preferably has a length less than or equal to a quarter wavelength so as not to resonate. A sub-line branching from the main line on the first main surface 11 extends in a direction perpendicular or substantially perpendicular to the main line and the end thereof defines the third port P3. One end of the capacitor C is connected to the third port P3. Note that the two ends (first and second ports P1 and P2) of the main line and the end (third port P3) of the sub-line extend over the side surfaces onto the second main surface 12 of the ferrite member 10 (refer to FIG. 3B). Here, the main line represents a conductor extending between the first port P1 and the second port P2, and the sub-line represents a conductor branching from the center of the main line and extending to the third port P3.

The mounting substrate 30 includes an input terminal electrode 31, an output terminal electrode 32, a relay terminal electrode 33, and a ground electrode 34 provided thereon. The ferrite member 10 and the permanent magnet 20 preferably have the same or substantially the same area, and the ferrite member 10 is mounted on the mounting substrate 30 in a state in which the permanent magnet 20 is pasted onto the first main surface 11. At this time, one end (first port P1) of the main line is connected to the input terminal electrode 31, the other end (second port P2) is connected to the output terminal electrode 32, and the end (third port P3) of the sub-line is connected to the relay terminal electrode 33. One end of the capacitor C is connected to the relay terminal electrode 33 and the other end is connected to the ground electrode 34.

In the magnetic resonance isolator 1A configured as described above, adjustment is preferably made such that a wave reflected from the sub-line connected to the capacitor C has a phase which is different by about 90 degrees from that of an input wave from each of the first port P1 and the second port P2 at the intersection of the junction conductor 15. In more detail, an input wave from the first port P1 is transmitted to the second port P2 because a negative circularly polarized wave is generated at the intersection due to a wave reflected from the sub-line and, thus, magnetic resonance is not generated. On the other hand, an input wave from the second port P2 is absorbed through magnetic resonance because a positive circularly polarized wave is generated at the intersection due to a wave reflected from the sub-line.

Figure 5A:
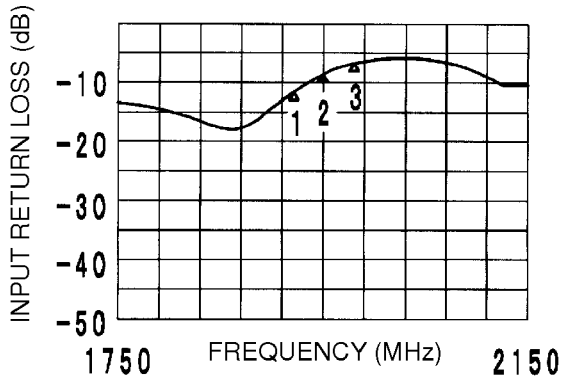
FIGS. 5A to 5D are graphs illustrating the characteristics of a magnetic resonance isolator according to a first preferred embodiment of the present invention.
Figure 5B:
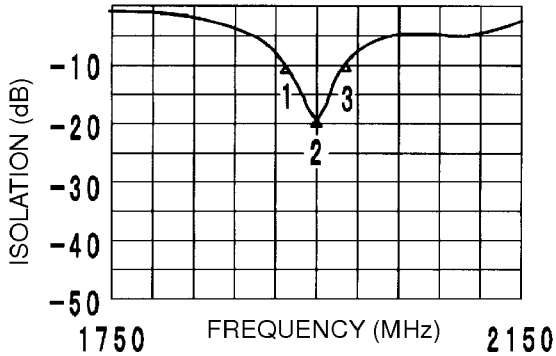
Figure 5C:
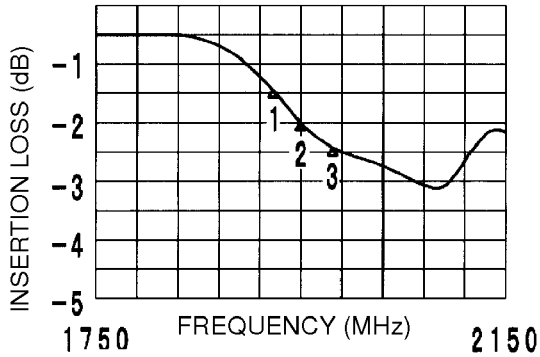
Figure 5D:
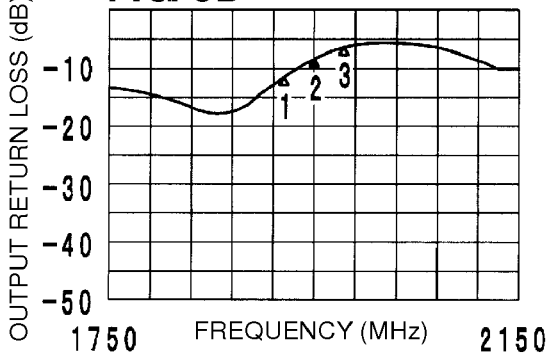
Figure 6:
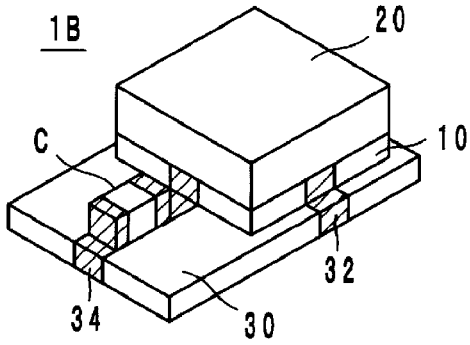
FIG. 6 is a perspective view of a magnetic resonance isolator according to a second preferred embodiment of the present invention.
Figure 7:
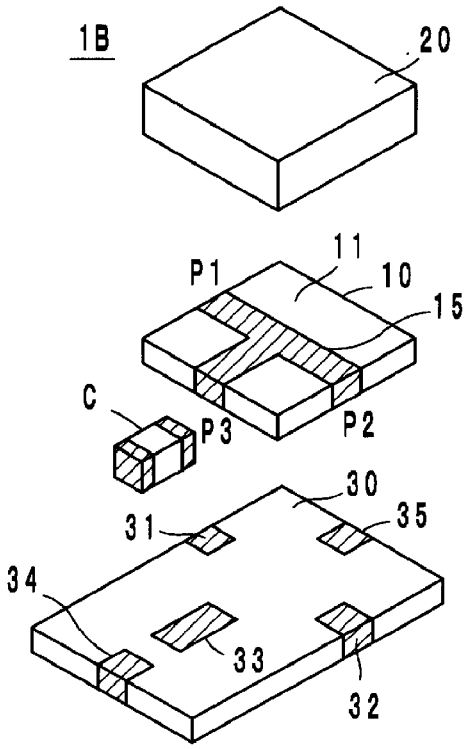
FIG. 7 is an exploded perspective view of a magnetic resonance isolator according to a second preferred embodiment of the present invention.

With regard to the magnetic resonance isolator 1A according to the first preferred embodiment, the input return loss is illustrated in FIG. 5A, the isolation is illustrated in FIG. 5B, the insertion loss is illustrated in FIG. 5C, and the output return loss is illustrated in FIG. 5D. The saturation magnetization is preferably about 100 mT and the capacitance of the capacitor C is preferably about 4 pF, for example. The impedance between the input terminal and output terminal is preferably about 2.4 dB, for example, and the isolation preferably is about 9.6 dB for about 1920 MHz to about 1980 MHz, for example.

Since the main line does not resonate, the main line can be shorter than or equal to a quarter wavelength, and in the first preferred embodiment, the ferrite member 10 is preferably about 0.6 mm long by about 0.6 mm wide and about 0.15 mm thick, for example. Thus, by using the ferrite member 10, which is much smaller than existing ferrite members, and the capacitor C as a reactance element, a small and low-impedance magnetic resonance isolator is obtained.

The magnetic resonance isolator 1A is preferably built into, for example, a transmitter circuit module of a mobile communication apparatus. The mounting substrate 30 may be a printed circuit board on which a power amplifier is mounted in the transmitter circuit module. In this case, the ferrite member 10 including the junction conductor 15 arranged thereon and the permanent magnet 20 pasted thereon is provided in an assembly step for the transmitter module. This is also true in the second to fifth preferred embodiments described below.

Second Preferred Embodiment

Figure 8A:
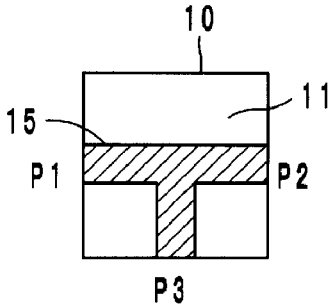
FIGS. 8A and 8B illustrate a front view and a back view, respectively, of a ferrite member of a magnetic resonance isolator according to a second preferred embodiment of the present invention.
Figure 8B:
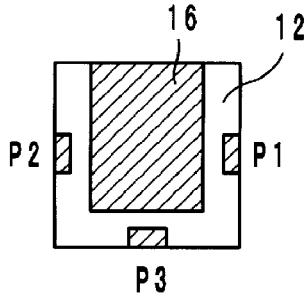
Figure 9:
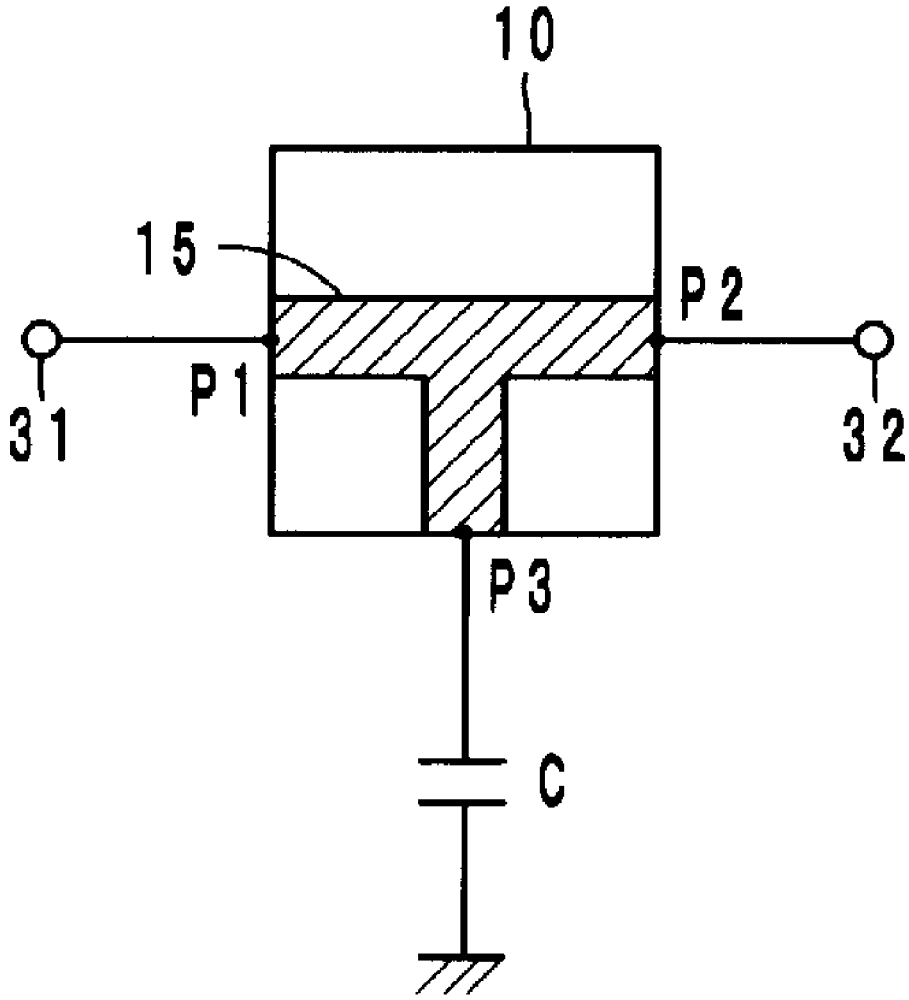
FIG. 9 is an equivalent circuit diagram of a magnetic resonance isolator according to a second preferred embodiment of the present invention.

Referring to FIG. 8B, in a magnetic resonance isolator 1B according to a second preferred embodiment of the present invention, a ground conductor 16 is provided on a second main surface 12 of the ferrite member 10 and a relay terminal electrode 35 to be connected to the ground conductor 16 is provided on the mounting substrate 30. The rest of the configuration is preferably similar to that of the first preferred embodiment. Thus, the second preferred embodiment produces operations and advantages which are similar to those of the first preferred embodiment.

Figure 10A:
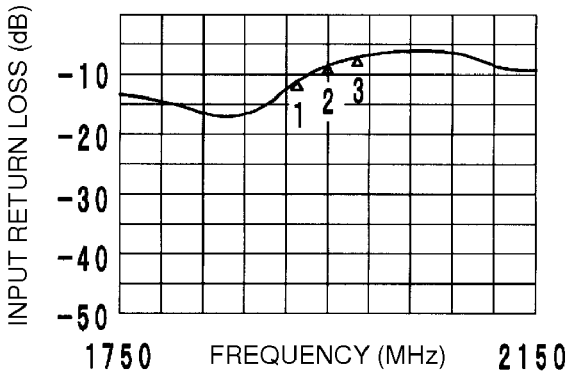
FIGS. 10A to 10D are graphs illustrating the characteristics of a magnetic resonance isolator according to a second preferred embodiment of the present invention.
Figure 10B:
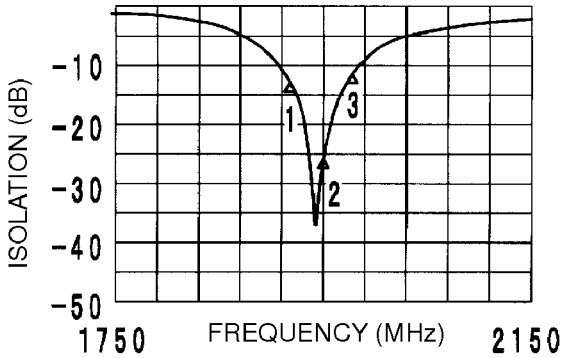
Figure 10C:
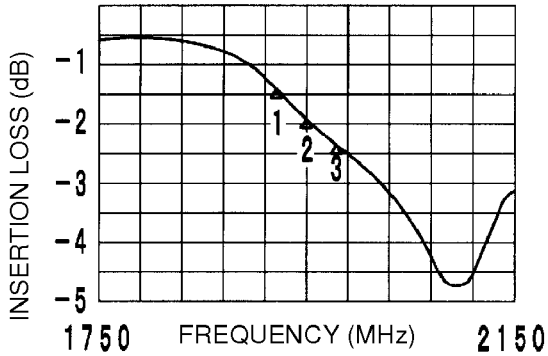
Figure 10D:
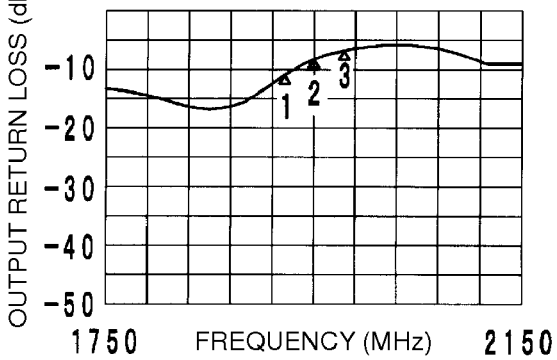
Figure 11:
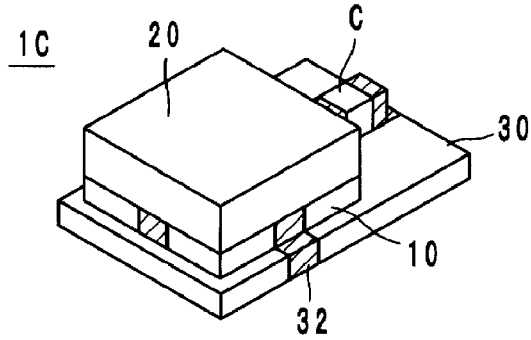
FIG. 11 is a perspective view of a magnetic resonance isolator according to a third preferred embodiment of the present invention.
Figure 12:
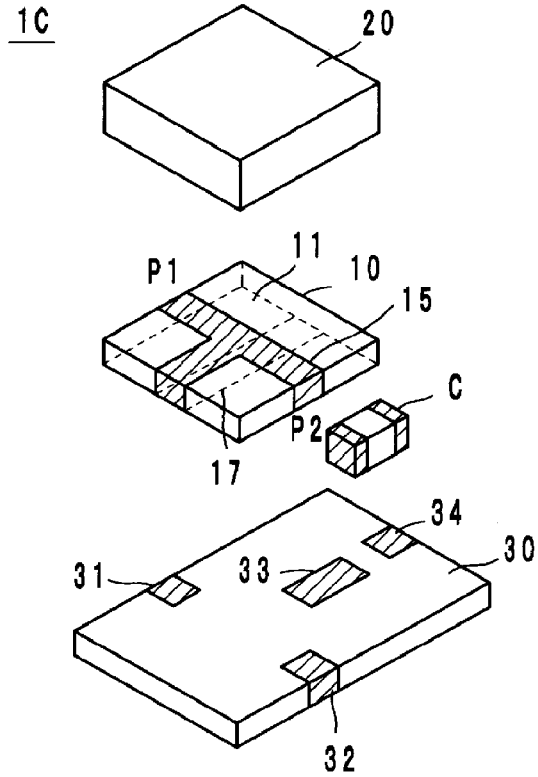
FIG. 12 is an exploded perspective view of a magnetic resonance isolator according to a third preferred embodiment of the present invention.

With regard to the magnetic resonance isolator 1B according to the second preferred embodiment, the input return loss is illustrated in FIG. 10A, the isolation is illustrated in FIG. 10B, the insertion loss is illustrated in FIG. 10C, and the output return loss is illustrated in FIG. 10D. The saturation magnetization is preferably about 100 mT and the capacitance of the capacitor C is preferably about 4 pF, for example. The impedance between the input terminal and output terminal is preferably about 20Ω, for example. The insertion loss is about 2.3 dB and the isolation is about 11.1 dB for about 1920 MHz to about 1980 MHz. The ferrite member 10 is preferably about 0.6 mm long by about 0.6 mm wide and about 0.15 mm thick, for example.

Third Preferred Embodiment

Figure 13A:
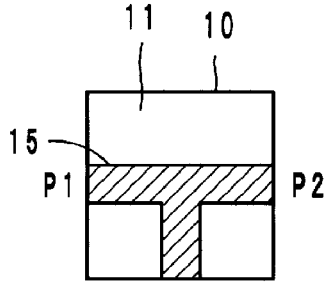
FIGS. 13A and 13B illustrate a front view and a back view, respectively of a ferrite member of a magnetic resonance isolator according to a third preferred embodiment of the present invention.
Figure 13B:
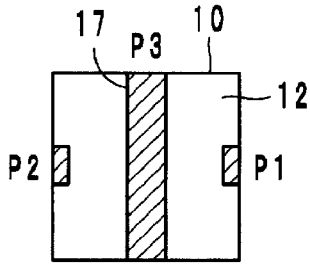
Figure 14:
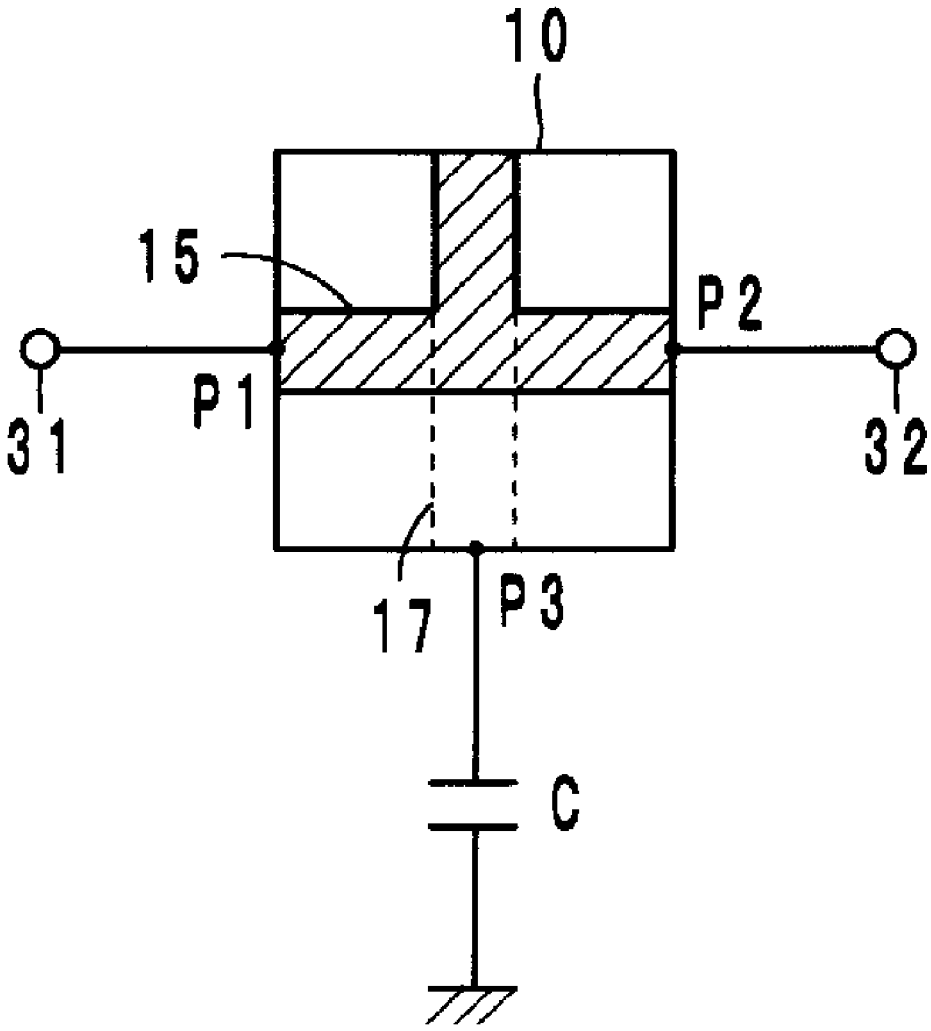
FIG. 14 is an equivalent circuit diagram of a magnetic resonance isolator according to a third preferred embodiment of the present invention.

In a magnetic resonance isolator 1C according to a third preferred embodiment of the present invention, the end of the sub-line branching from the main line of the junction conductor 15 on the first main surface 11 preferably includes an opposing conductor 17 (refer to FIG. 13B) which extends along the second main surface 12 in a direction perpendicular or substantially perpendicular to the main line. The end of the opposing conductor 17 defines the third port P3, which is connected to the relay terminal electrode 33. The capacitor C is connected between the relay terminal electrode 33 and the ground electrode 34. In the third preferred embodiment, the rest of the configuration is preferably similar to that of the first preferred embodiment. Thus, the third preferred embodiment produces operations and advantages which are similar to those of the first preferred embodiment.

Figure 15A:
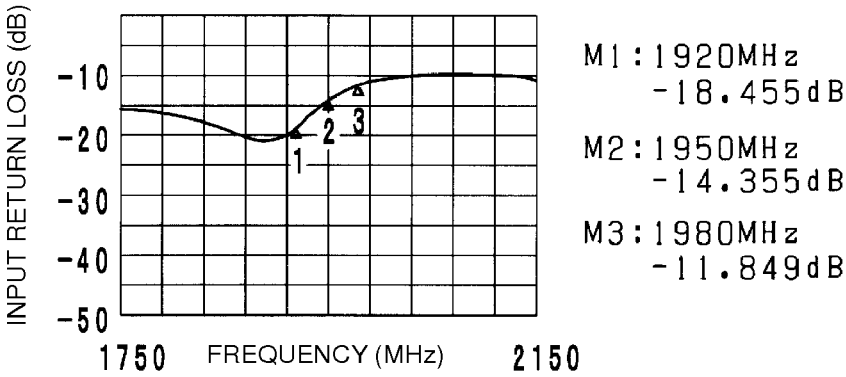
FIGS. 15A to 15D are graphs illustrating the characteristics of a magnetic resonance isolator according to a third preferred embodiment of the present invention.
Figure 15B:
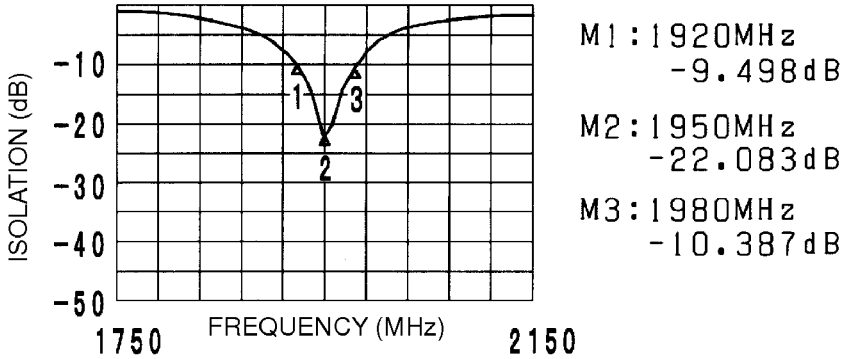
Figure 15C:
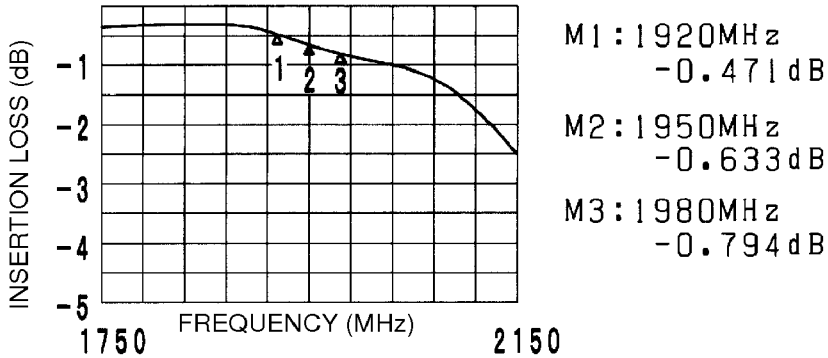
Figure 15D:
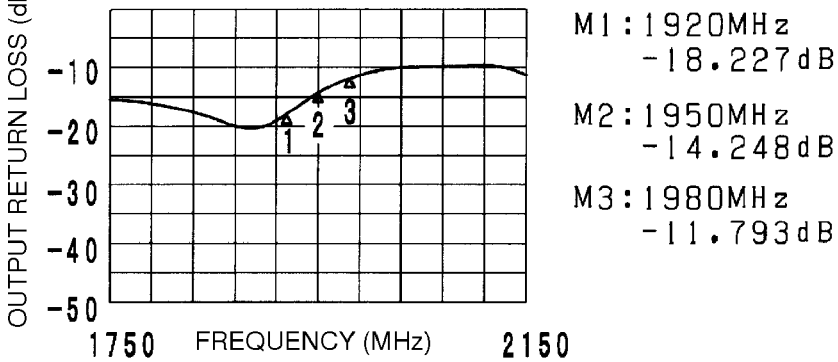

With regard to the magnetic resonance isolator 1C according to the third preferred embodiment, the input return loss is illustrated in FIG. 15A, the isolation is illustrated in FIG. 15B, the insertion loss is illustrated in FIG. 15C, and the output return loss is illustrated in FIG. 15D. The saturation magnetization is preferably about 100 mT and the capacitance of the capacitor C is preferably about 3 pF, for example. The impedance between the input terminal and output terminal is preferably about 20 Ωm, for example. The insertion loss is about 0.8 dB and the isolation is about 9.5 dB for about 1920 MHz to about 1980 MHz. The ferrite member 10 is preferably about 0.6 mm long by about 0.6 mm wide and about 0.15 mm thick, for example.

In the third preferred embodiment, the insertion loss characteristics and isolation characteristics are excellent. The reason for this is that, since the opposing conductor 17 extending in a direction perpendicular or substantially perpendicular to the main line between the first and second ports P1 and P2 is arranged in a state in which the opposing conductor 17 is connected to the third port P3, a high-frequency magnetic field is confined within the ferrite member 10 due to the opposing conductor 17, whereby leakage of the magnetic flux is reduced.

Fourth Preferred Embodiment

Figure 16:
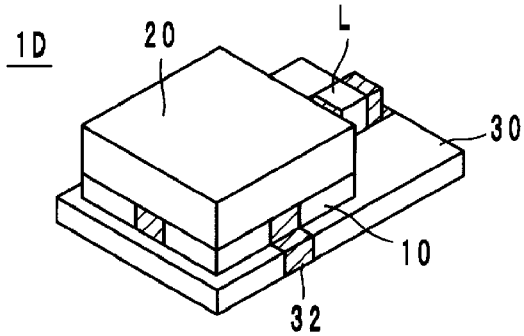
FIG. 16 is a perspective view of a magnetic resonance isolator according to a fourth preferred embodiment of the present invention.
Figure 17:
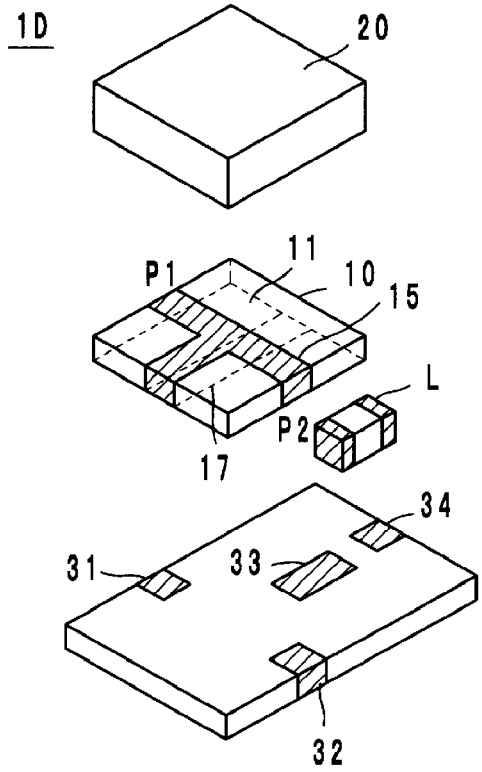
FIG. 17 is an exploded perspective view of a magnetic resonance isolator according to a fourth preferred embodiment of the present invention.
Figure 18A:
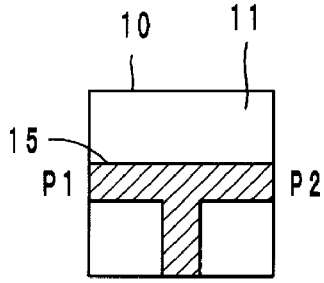
FIGS. 18A and 18B illustrate a front view and a back view, respectively, of a ferrite member of a magnetic resonance isolator according to a fourth preferred embodiment of the present invention.
Figure 18B:
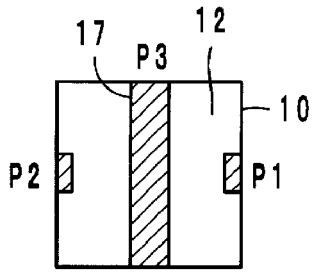
Figure 19:
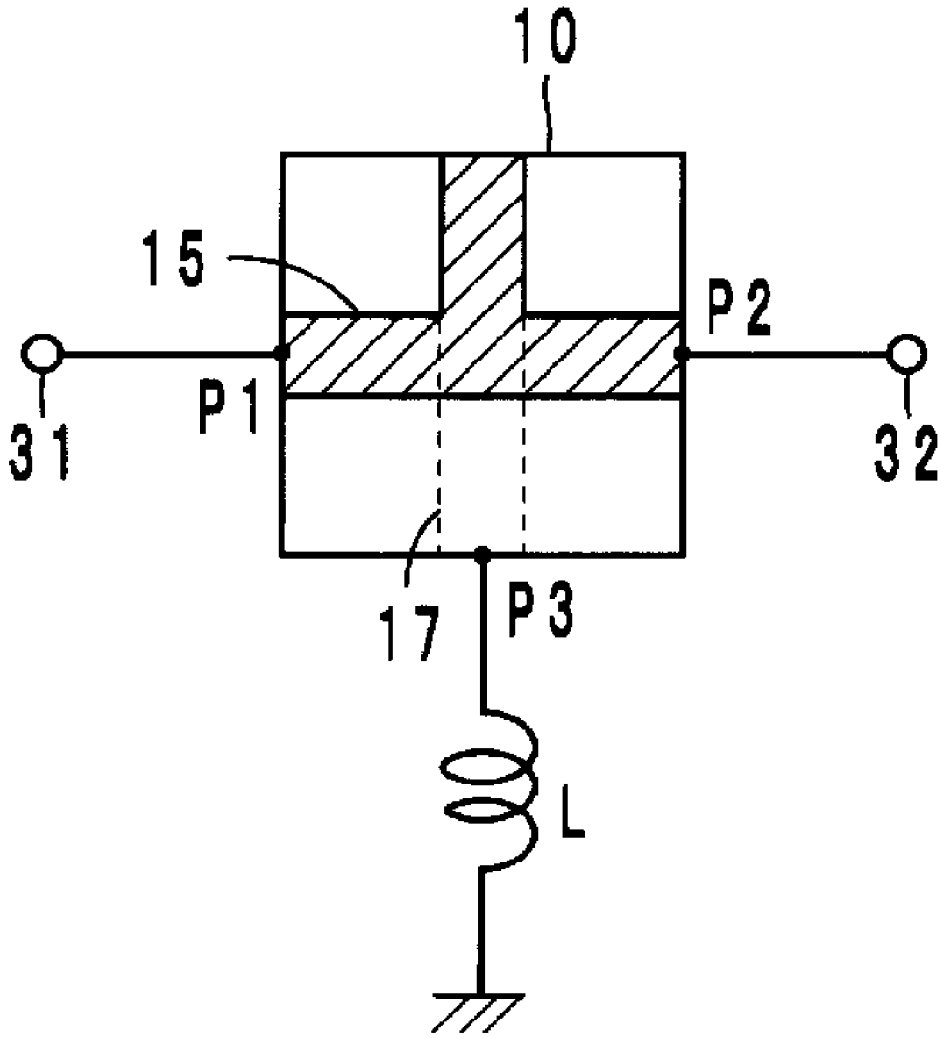
FIG. 19 is an equivalent circuit diagram of a magnetic resonance isolator according to a fourth preferred embodiment of the present invention.

Referring to FIGS. 16 and 17, in a magnetic resonance isolator 1D according to a fourth preferred embodiment of the present invention, an inductor L is preferably provided as a reactance element instead of the capacitor C. The rest of the configuration is preferably similar to that of the third preferred embodiment. Thus, the fourth preferred embodiment produces operations and advantages which are similar to those of the third preferred embodiment.

Figure 20A:
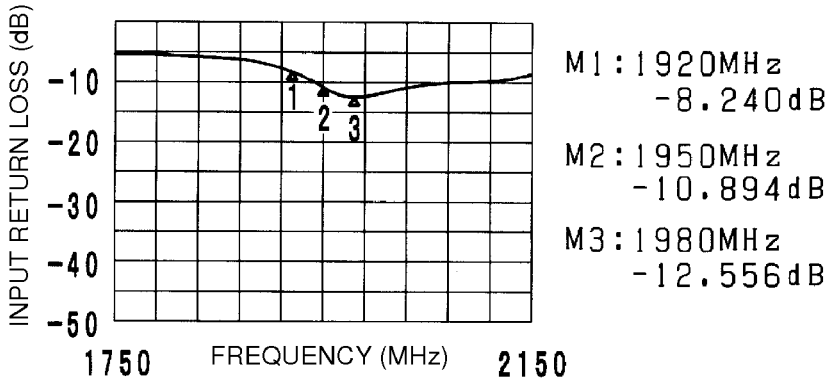
FIGS. 20A to 20D are graphs illustrating the characteristics of a magnetic resonance isolator according to a fourth preferred embodiment of the present invention.
Figure 20B:
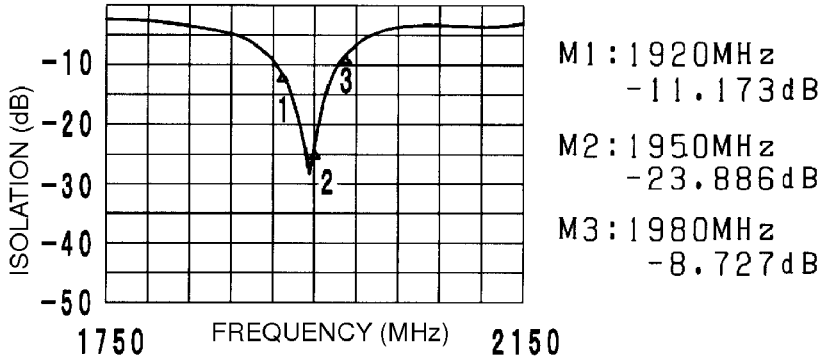
Figure 20C:
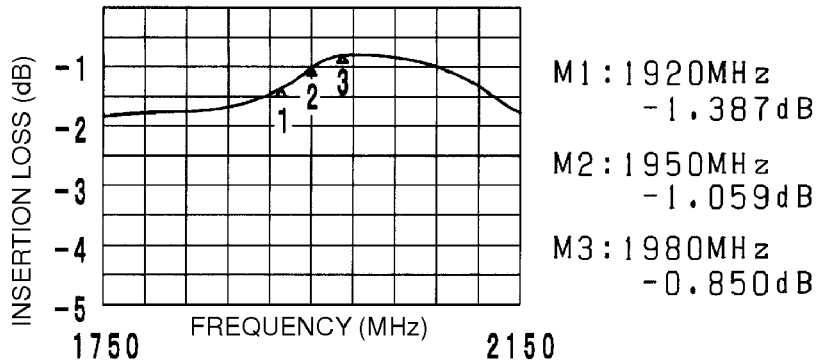
Figure 20D:
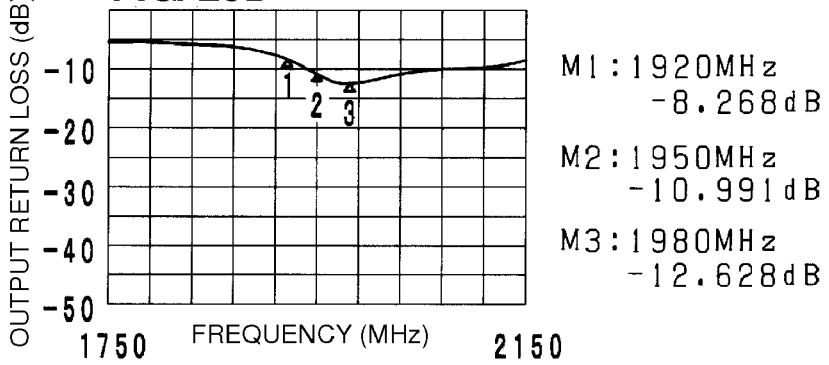

With regard to the magnetic resonance isolator 1D according to the fourth preferred embodiment, the input return loss is illustrated in FIG. 20A, the isolation is illustrated in FIG. 20B, the insertion loss is illustrated in FIG. 20C, and the output return loss is illustrated in FIG. 20D. The saturation magnetization is preferably about 100 mT and the inductance of the inductor L is preferably about 2 nH, for example. The impedance between the input terminal and output terminal is preferably about 30Ω, for example. The insertion loss is about 1.4 dB and the isolation is about 8.7 dB for about 1920 MHz to about 1980 MHz. The ferrite member 10 is preferably about 0.6 mm long by about 0.6 mm wide and about 0.15 mm thick, for example.

Fifth Preferred Embodiment

Figure 21:
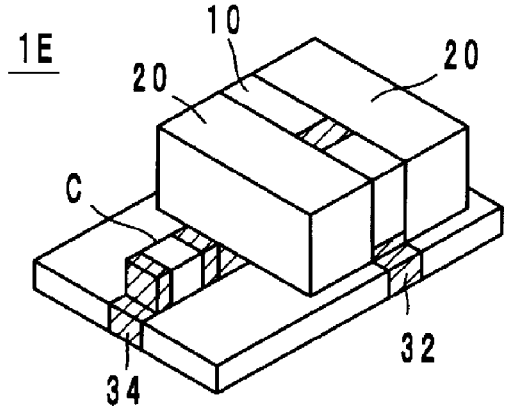
FIG. 21 is a perspective view of a magnetic resonance isolator according to a fifth preferred embodiment of the present invention.
Figure 22:
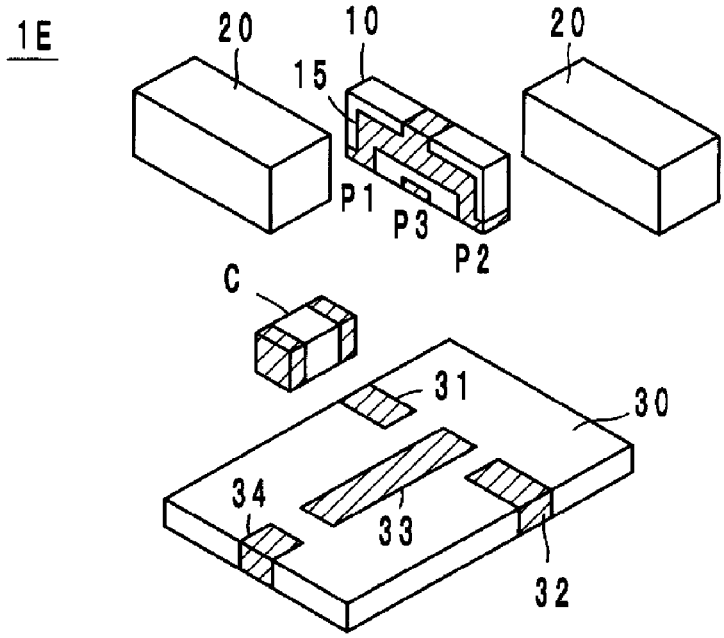
FIG. 22 is an exploded perspective view of a magnetic resonance isolator according to a fifth preferred embodiment of the present invention.
Figure 23A:
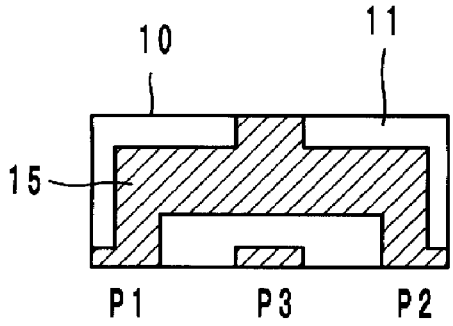
FIGS. 23A and 23B illustrate a front view and a back view, respectively, of a ferrite member of a magnetic resonance isolator according to a fifth preferred embodiment of the present invention.
Figure 23B:
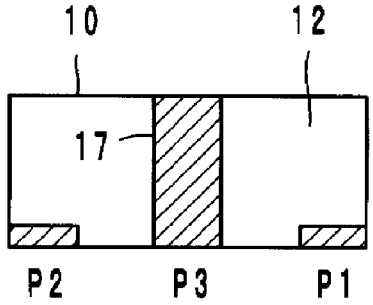
Figure 24:
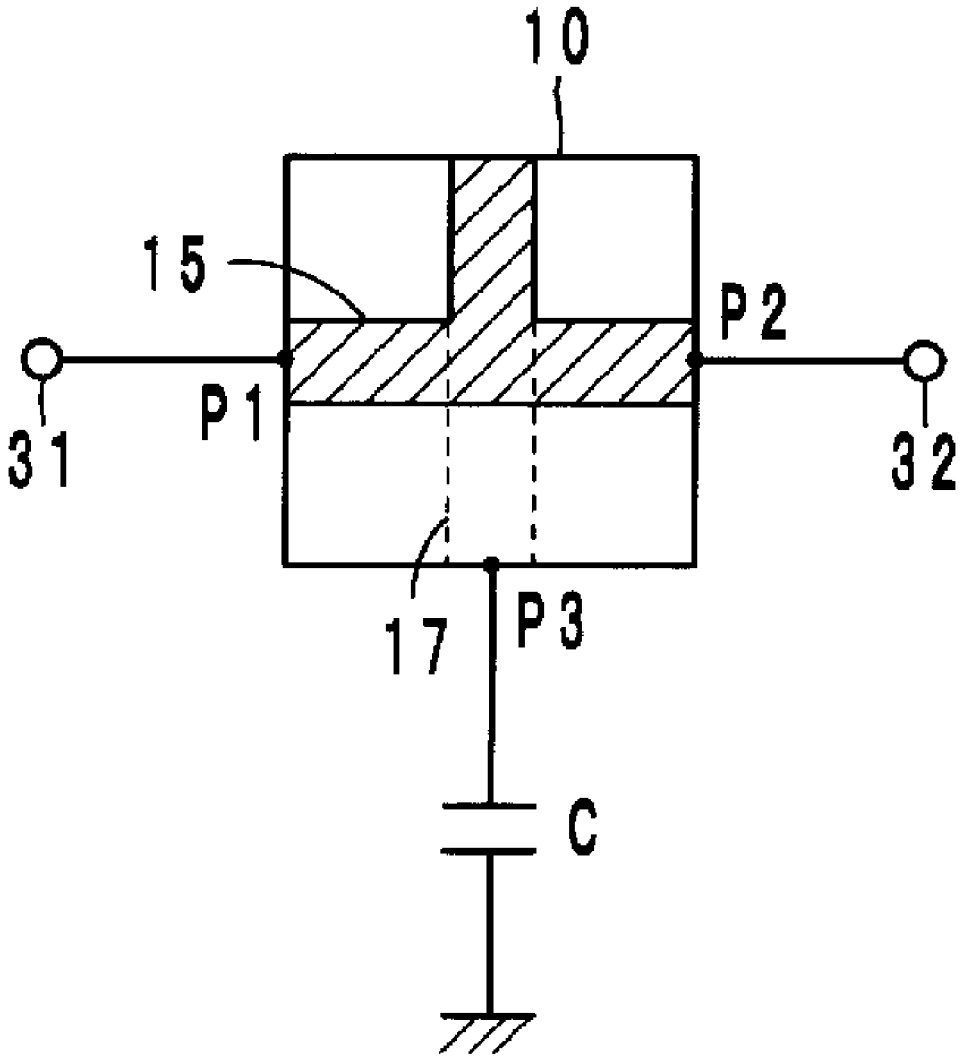
FIG. 24 is an equivalent circuit diagram of a magnetic resonance isolator according to a fifth preferred embodiment of the present invention.

Referring to FIGS. 21, 23A, 23B, in a magnetic resonance isolator 1E according to a fifth preferred embodiment of the present invention, the junction conductor 15 is preferably arranged on the first main surface 11 of a ferrite member 10 so as to have a substantially rectangular parallelepiped shape, and one end thereof defines the first port P1 and the other end thereof defines the second port P2. The sub-line branching from the center of the main line between the first and second ports P1 and P2 extends from the upper surface of the ferrite member 10 to the second main surface 12 and includes the opposing conductor 17 extending perpendicular or substantially perpendicular to the main line. The end of the opposing conductor 17 extends from the second main surface 12 of the ferrite member 10 over the lower surface onto the first main surface 11, and defines the third port P3. The main line preferably has a length less than or equal to a quarter wavelength so as not to resonate.

The ferrite member 10 is sandwiched between a pair of permanent magnets 20 respectively facing the first and second main surfaces 11 and 12, and is mounted on the mounting substrate 30 in a direction such that the first and second main surfaces 11 and 12 are perpendicular or substantially perpendicular to the surface of the mounting substrate 30 (in other words, vertically or substantially vertically arranged).

The mounting substrate 30 preferably includes the input terminal electrode 31, the output terminal electrode 32, the relay terminal electrode 33, and the ground electrode 34 provided thereon. One end (first port P1) of the junction conductor 15 is connected to the input terminal electrode 31, the other end (second port P2) is connected to the output terminal electrode 32, and the end (third port P3) of the opposing conductor 17 is connected to the relay terminal electrode 33. One end of the capacitor C is connected to the relay terminal electrode 33 and the other end is connected to the ground electrode 34.

Figure 25A:
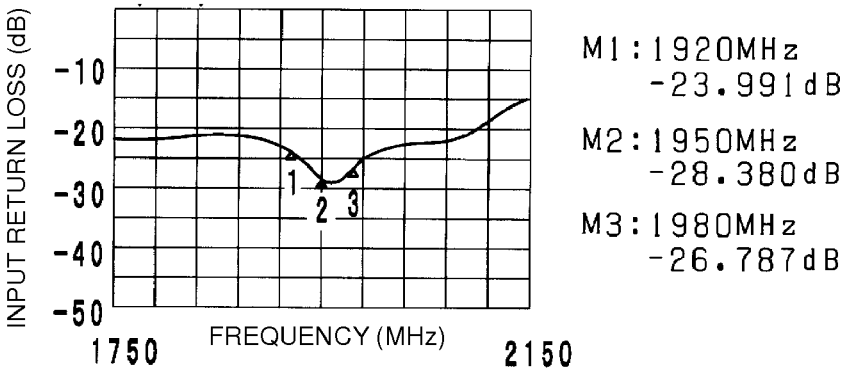
FIGS. 25A to 25D are graphs illustrating the characteristics of a magnetic resonance isolator according to a fifth preferred embodiment of the present invention.
Figure 25B:
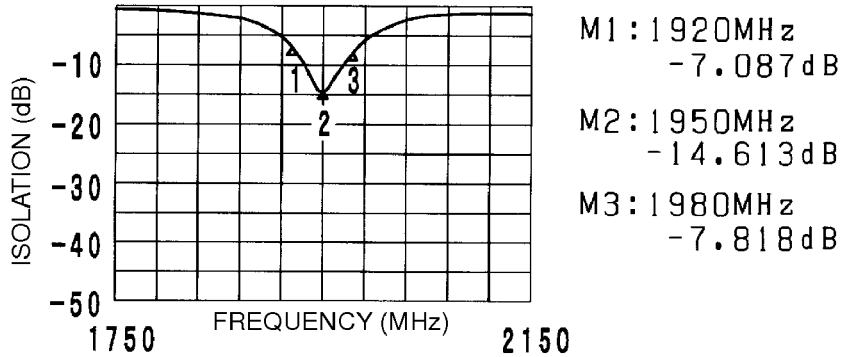
Figure 25C:
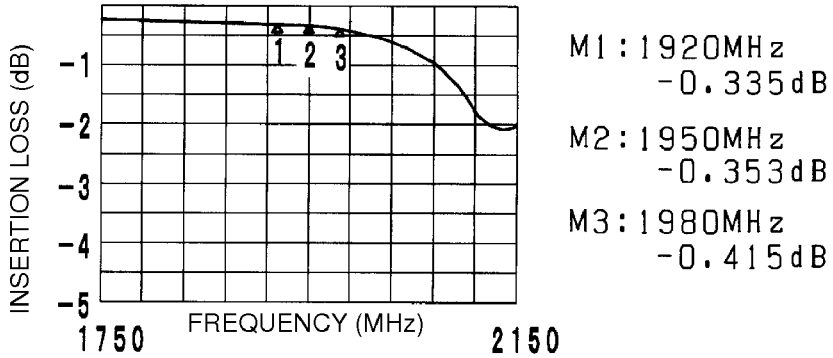
Figure 25D:
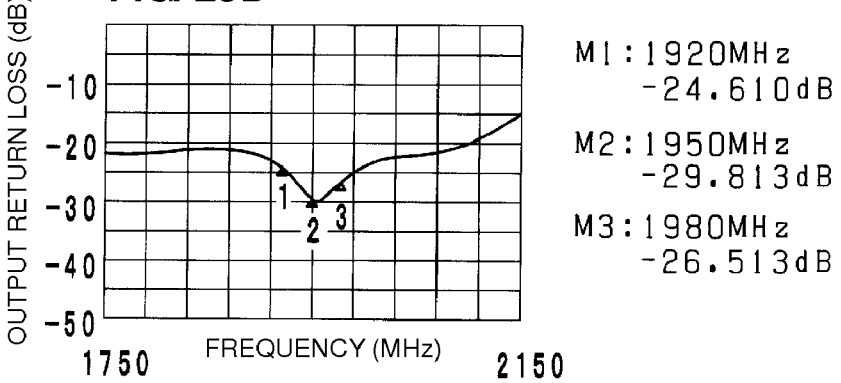

With regard to the magnetic resonance isolator 1E according to the fifth preferred embodiment, the input return loss is illustrated in FIG. 25A, the isolation is illustrated in FIG. 25B, the insertion loss is illustrated in FIG. 25C, and the output return loss is illustrated in FIG. 25D. The saturation magnetization is preferably about 100 mT and the capacitance of the capacitor C is preferably about 2 pF, for example. The impedance between the input terminal and output terminal is preferably about 20Ω, for example. The insertion loss is about 0.42 dB and the isolation is about 7.1 dB for about 1920 MHz to about 1980 MHz. The ferrite member 10 is preferably about 0.4 mm long by about 0.8 mm wide and about 0.15 mm thick, for example. In the fifth preferred embodiment, outstanding insertion loss characteristics and reductions in the size and height are achieved.

In the fifth preferred embodiment, since only a portion of the junction conductor 15 parallel or substantially parallel to the thickness direction and provided on the ferrite member 10 which is arranged vertically or substantially vertically on the mounting substrate 30 faces a ground electrode (not illustrated), the impedance is increased and the insertion loss is reduced.

Note that the magnetic resonance isolator according to the present invention is not limited to the above-described preferred embodiments, and various modifications are possible within the scope of the present invention.

For example, the junction conductor need not be T-shaped, and the intersection may have an angle slightly larger or smaller than about 90 degrees. In addition, the mounting substrate may have any suitable dimensions, shape, or structure.

As described above, preferred embodiments of the present invention are useful for magnetic resonance isolators, and specifically are advantageous in that a reduction in size and a low impedance are achieved.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A magnetic resonance isolator comprising:

a ferrite member;

a junction conductor arranged on the ferrite member and including a first port, a second port, and a third port; and a permanent magnet arranged to apply a direct current magnetic field to the ferrite member; wherein the junction conductor includes a main line arranged between the first port and the second port and a sub-line branching from the main line and extending to the third port, and the main line does not resonate; and a reactance element is connected to the third port and to ground.

2. The magnetic resonance isolator according to claim 1, wherein a ground conductor is provided on a main surface of the ferrite member.

3. The magnetic resonance isolator according to claim 1, wherein the reactance element is a capacitor.

4. The magnetic resonance isolator according to claim 1, wherein the reactance element is an inductor.

5. A magnetic resonance isolator comprising:

a ferrite member including a first main surface and a second main surface facing each other;

a junction conductor arranged on the first main surface of the ferrite member and including a first port, a second port, and a third port; and a permanent magnet arranged to apply a direct current magnetic field to the ferrite member; wherein the junction conductor includes a main line arranged between the first port and the second port and a sub-line branching from the main line and extending to the third port, and the main line does not resonate; and the sub-line includes an opposing conductor extending along the second main surface of the ferrite member in a direction perpendicular or substantially perpendicular to the main line, an end of the opposing conductor defines the third port, and a reactance element is connected to the third port and to ground.

6. The magnetic resonance isolator according to claim 5, wherein a ground conductor is provided on the second main surface of the ferrite member.

7. The magnetic resonance isolator according to claim 5, wherein the reactance element is a capacitor.

8. The magnetic resonance isolator according to claim 5, wherein the reactance element is an inductor.

9. A magnetic resonance isolator comprising:

a ferrite member including a first main surface and a second main surface facing each other;

a junction conductor arranged on the first main surface of the ferrite member and including a first port, a second port, and a third port;

a permanent magnet arranged to apply a direct current magnetic field to the ferrite member, and a mounting substrate; wherein the junction conductor includes a main line arranged between the first port and the second port and a sub-line branching from the main line and extending to the third port, and the main line does not resonate;

an end of the sub-line defines the third port and a reactance element is connected to the third port and to ground; and the ferrite member is sandwiched between a pair of permanent magnets respectively facing the first and second main surfaces of the ferrite member, and mounted on the mounting substrate such that the first and second main surfaces of the ferrite member extend in a direction perpendicular or substantially perpendicular to a surface of the mounting substrate.

10. The magnetic resonance isolator according to claim 9, wherein the sub-line includes an opposing conductor extending along the second main surface of the ferrite member in a direction perpendicular or substantially perpendicular to the main line, and an end of the opposing conductor defines the third port.

11. The magnetic resonance isolator according to claim 9, wherein a ground conductor is provided on the second main surface of the ferrite member.

12. The magnetic resonance isolator according to claim 9, wherein the reactance element is a capacitor.

13. The magnetic resonance isolator according to claim 9, wherein the reactance element is an inductor.

* * * * *